United States Patent [19]

Sampson et al.

[11] Patent Number: 4,589,238

[45] Date of Patent: May 20, 1986

[54] SKYLIGHT SEALING

[75] Inventors: Robert C. Sampson, Sanford; Sean T. Flanigan, Wells, both of Me.

[73] Assignee: Wasco Products, Inc., Sanford, Me.

[21] Appl. No.: 749,947

[22] Filed: Jun. 27, 1985

[51] Int. Cl.[4] ..... E04B 7/18

[52] U.S. Cl. ..... 52/200

[58] Field of Search ..... 52/200, 58-60, 52/72

[56] References Cited

U.S. PATENT DOCUMENTS 4,154,028 5/1979 Spaulding ..... 52/60

4,439,962 3/1984 Jentoft et al. ..... 52/200

4,449,340 5/1984 Jentoft et al. ..... 52/200

4,527,368 7/1985 Jentoft ..... 52/58

*Primary Examiner*—James L. Ridgill, Jr.

*Attorney, Agent, or Firm*—Wolf, Greenfield & Sacks

[57] ABSTRACT

A technique for sealing a skylight at its curb frame about an opening in a building and in which the sealing technique is a dry sealing technique. In accordance with the invention, means are provided for directly securing the curb frame to the building. A flexible flashing flange extends from the base of the curb frame and is disposed about the periphery of the curb frame having a plurality of elongated spaced upstanding ribs that form flow diverters extending peripherally about the curb frame.

12 Claims, 4 Drawing Figures

SKYLIGHT SEALING

BACKGROUND OF THE INVENTION

The present invention relates in general to skylights and the like, and is concerned, more particularly, with an improved technique for sealing the skylight about a roof or other building opening.

At the present time, a skylight is conventionally secured to a roof or other appropriate part of the building with the use of a roofing mastic. In an existing building, after the roof opening has been made, the roofing mastic is applied on the deck around the opening to provide a seal between the deck and the flange of the skylight. Once the roofing mastic is applied, then the skylight is positioned over the opening and the flange is then pressed firmly into the mastic to provide a water tight seal. The skylight flange is then nailed to the roof and additional mastic applied. Shingling is then completed about the entire skylight.

Now, there are a number of disadvantages associated with this conventional well-known procedure for sealing a skylight. There is extra expense associated in purchasing the roofing mastic and there is associated expense of the labor involved in applying the mastic. The application of a roofing cement also adds to the installation time of the skylight unit. The roofing mastic product is extremely messy, particularly for an inexperienced remodeler or one involved in a do-it-yourself project. Furthermore, the success of the installation, particularly as it relates to resisting water leakage is a function of steps that are taken that take place in the field and have nothing to do with the manufacturing of the unit. Because of this, there are many uncertainties that are involved. Also, the resistance of the unit to leakage involves the proper performance of the mastic. Because there are a large number of different mastics that are available, this introduces great variables into the desired performance.

Reference is also made to copending application Ser. No. 453,339 commonly owned by the assignee herein and which describes a sealing technique for skylights. Although this technique is effective in the preferred embodiment, it uses one or more nails for piercing the flange. This may have the effect of causing further leakage problems at the flange.

Accordingly, it is an object of the present invention to provide an improved technique for the sealing of a skylight about a building opening, and in which the sealing flange is secured preferably without requiring the piercing by nails or other fasteners therethrough.

Another object of the present invention is to provide a sealing technique as in accordance with the previous object, particularly adapted for sealing skylights and which is a dry seal technique.

A further object of the present invention is to provide an improved sealing technique as set forth hereinbefore and in which the sealing is provided by a dry seal, co-extruded element.

Still another object of the present invention is to provide a technique for sealing a skylight to a building about an opening in the building and without requiring the use of messy, expensive and time consuming roofing cements or mastics.

Still a further object of the present invention is to provide an improved skylight sealing technique that eliminates uncertainties when the unit is installed in the field due to inherent invariables associated with field installation.

Still another object of the present invention is to provide an improved skylight sealing technique that is particularly useful in skylight installations wherein skylights are butted closely together. Adjacent skylight flanges are adapted to overlap without the required use of caulking or mastic therebetween.

A further object of the present invention is to provide an improved skylight sealing technique in which the fastening of the skylight curb is carried out by separate means whereby the structural securing of the skylight curb frame does not rely upon a securing of the flange itself directly to the building.

Still a further object of the present invention is to provide an improved skylight sealing technique employing a co-extruded flexible flashing flange having a series of upwardly directed flow diverter ribs for assuring proper sealing and water deflection.

SUMMARY OF THE INVENTION

To accomplish the foregoing and other objects, features and advantages of the invention, there is provided a skylight for covering an opening in a building having a curb frame with a co-extruded peripheral flexible flashing flange extending thereabout. This flashing flange is made of a flexible plastic material and is co-extruded with the curb frame. The bottom surface of the flashing flange is preferably substantially flat while the upper surface thereof has closely spaced upstanding ribs that form flow diverters so as to divert water away from the building. In accordance with the installation of the skylight, the skylight curb frame itself is secured by separate clip means so that the securing of the curb frame does not have to rely upon a securing through the flashing flange itself. As a matter of fact, in a preferred embodiment of the present invention, the flashing flange itself is adapted to have no nails or other fasteners passing therethrough. This thus minimizes any chance for water entering the building about the skylight through the flashing flange membrane. In the installation of the unit, the flashing flange is simply lifted and the clip means is inserted into a slot in the curb frame. The clip means is then secured by nails or other fasteners and the flashing flange is then placed thereover. The shingles that are adapted to fit adjacent to the skylight are then placed over the co-extruded flexible flashing flange and it is preferred that in nailing these shingles that no nails be directed through the shingle and through the flashing flange. The nailing of the shingles simply occurs outside of the co-extruded flexible flashing flange.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
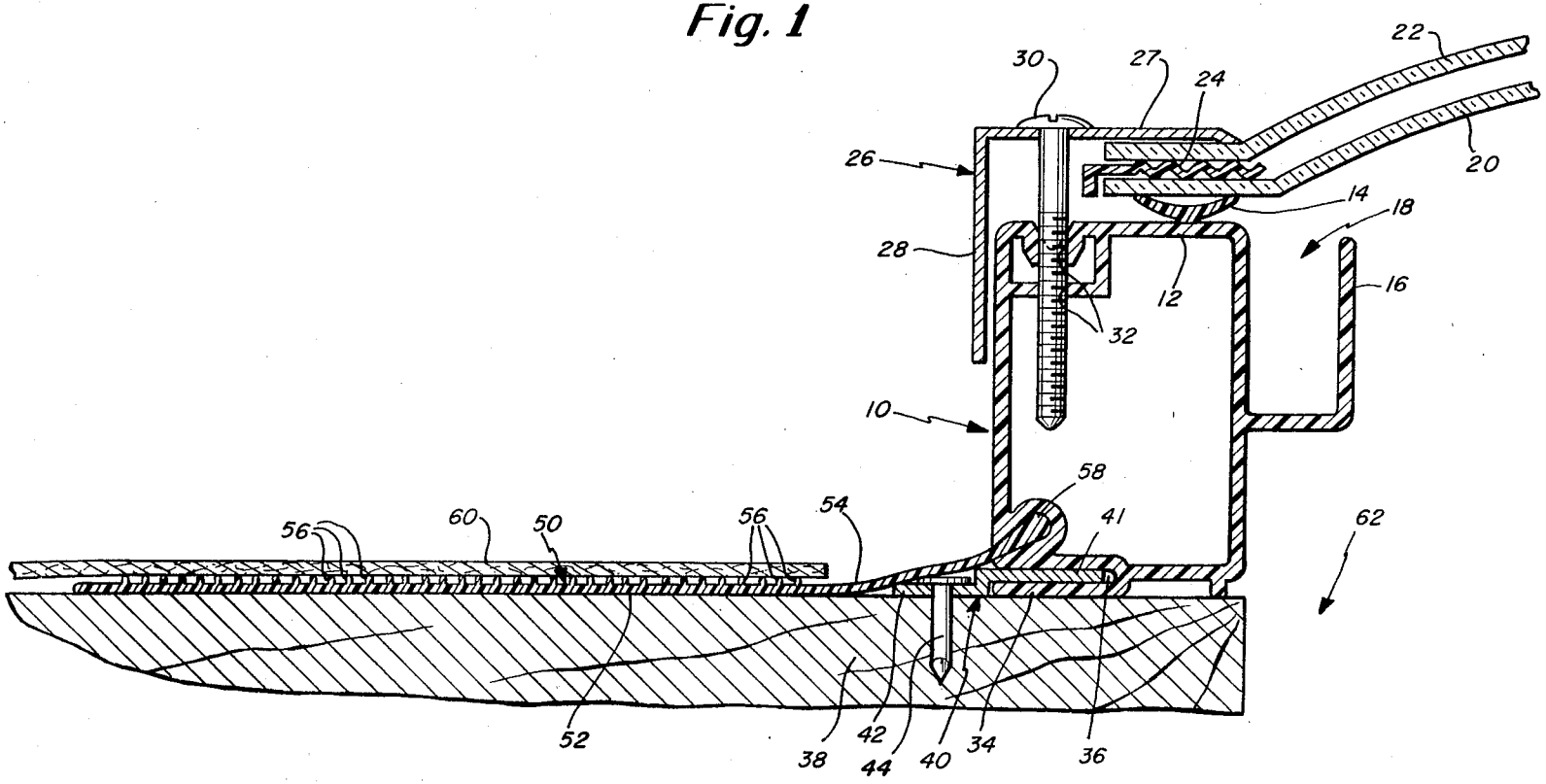
FIG. 1 is a cross-sectional view through a curb frame of a complete skylight unit illustrating the rigid curb frame and the co-extruded flexible flashing flange.

FIG. 1 is a cross-sectional view through a preferred embodiment of the curb frame of the present invention. FIG. 1 also illustrates the co-extruder flexible flashing flange of the invention. This integral peripheral flashing flange provides a much simpler alternative in the installation of skylights not requiring the use of roofing cement or step flashing kits. This embodiment of the invention also offers the additional benefit and flexibility of offering an installer the convenience of arranging adjacent units together in a cluster by simply trimming and gluing overlapping flashing pieces so as to essentially form a one-piece, self-flashing skylight. At the present time, clusters of skylights are interconnected by more complex techniques requiring complex mulling kits or are made in custom factory built units. In accordance with the present invention, the unit itself and the method of installation are extremely simple requiring fewer pieces and relatively simple instructions to be described in further detail hereinafter.

Figure 2:
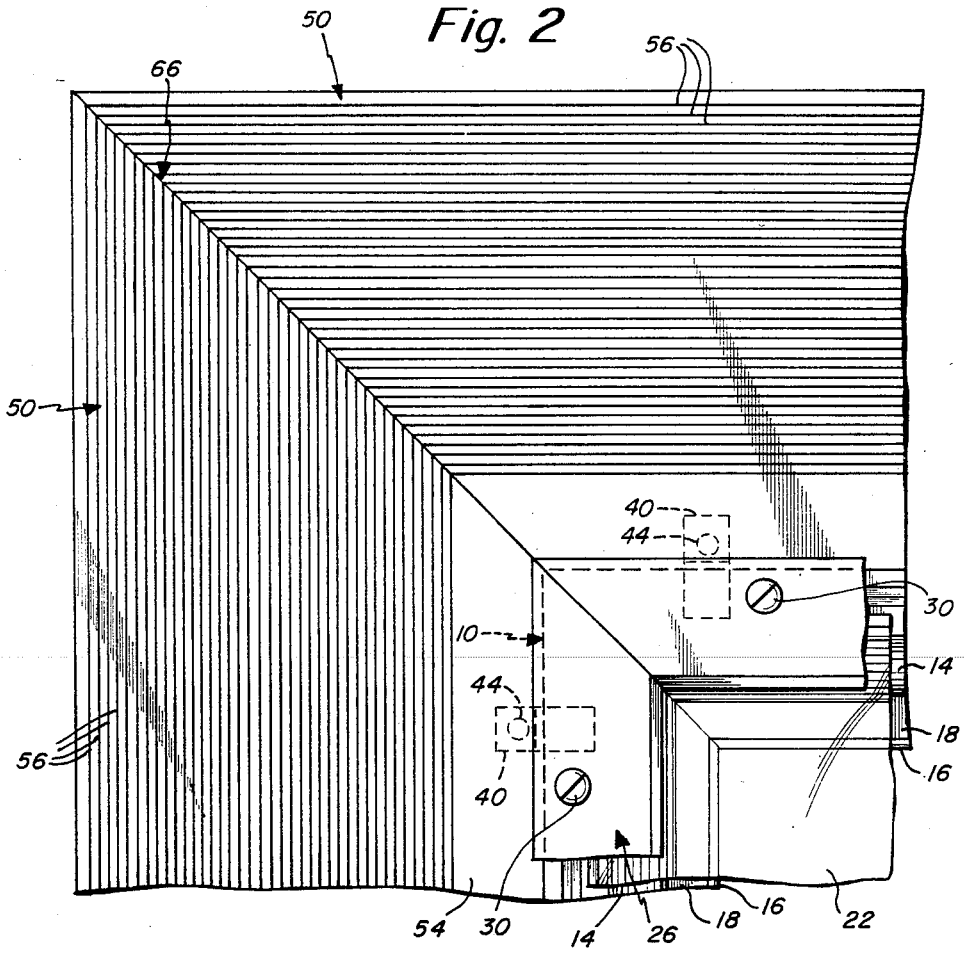
FIG. 2 is a fragmentary plan view illustrating in particular the miter connection of the curb frame and associated co-extruded flexible flashing flange.
Figure 3:
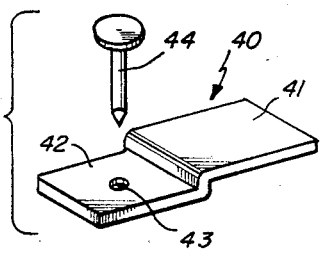
FIG. 3 is a perspective view illustrating the securing clip employed in connection with the invention.

Referring now to FIGS. 1–3, there is shown a skylight curb frame 10 that is constructed of a rigid plastic material, preferably a rigid PVC. The rigid curb frame 10 has a top wall 12 that is adapted to support the co-extruded glazing gasket 14. The curb frame 10 also has an inwardly directed wall 16 defining a condensation gutter 18. With regard to the glazing gasket 14, it is noted that this is co-extruded with the curb frame 10 but while the curb frame 10 is of a rigid PVC material, the gasket 14 is of a more flexible material.

FIG. 1 also illustrates the acrylic domes which comprise an acrylic inner dome 20 and an acrylic outer dome 22. The outer flange of the dome 20 rests upon the co-extruded glazing gasket 14. The outer dome 22 has its flange overlying the flange of the inner dome. In between these two flanges there is provided an extruded and welded dome seal gasket 24. The inner and outer acrylic domes along with the respective gaskets are maintained in place by means of the aluminum retainer 26 which includes a horizontal leg 27 and a vertical leg 28. A screw fastener 30 passes through the leg 27 and is secured appropriately in a receiving hole at 32 in the curb frame 10.

At the bottom of the curb frame 10 there is provided a leg 34 defining a slot 36. The slot 36 may extend about the entire periphery of the curb frame. The slot 36 is provided primarily for the purpose of securing the curb frame 10 itself directly to the building member 38. In order to carry out this securing, there is provided a securing clip 40. Depending upon the size of the skylight, four more of these securing clips may be disposed along the sides of the skylight.

Reference is now made to the perspective view of FIG. 3 which shows one version of the securing clip 40. The clip 40 has one end 41 that is adapted to fit within the slot 36 in the curb frame. The securing clip 40 also has another end 42 that is adapted to lie upon the building member 38 for securing thereto. For this purpose, the end 42 has a hole 43 for receiving a nail 44 or other fastener. The hole 43 may be prepunched. The securing clip 40 may be constructed of plastic or metal.

The flashing flange 50 is preferably constructed of a flexible PVC plastic. The flange 50 is co-extruded with the rigid curb frame 10 in the same manner as the co-extrusion of the glazing gasket 14. The co-extruded flexible flashing flange 15 may have a length on the order of 6 inches and has a flat bottom surface 52. The top surface 54 is provided with a series of upstanding ribs 56. FIG. 1 shows the flange 50 secured at end 58 thereof. This is secured within the rigid curb frame as illustrated in FIG. 1. The upstanding ribs 56 extend longitudinally as noted in FIG. 2 and form a series of flow diverters so that should any water enter under the shingle 16 between the shingle and these ribs, then the water will simply run down the roof and be diverted away from any area where the water might enter under the flashing flange. It is noted that there are a number of these ribs provided in relatively closely spaced relationship so that should the water pass one rib, there are a number of adjacent ribs to provide flow diversion. Also, because of the substantial number of ribs that are employed, there are also a number of contact points between the shingle that is disposed over the flashing flange and the flashing flange itself. With regard to the flow diversion, even at the bottom of the skylight where the ribs will tend to run substantially horizontally, these ribs are of very small height and thus any water directed from the side disposed ribs simply for the most part deflected off of the bottom flange.

In accordance with the installation of the skylight illustrated in FIGS. 1–3, there is provided the usual opening in a building illustrated at 62 in FIG. 1 and the curb frame is adapted to be positioned about this opening on the building member 38. Between the base of the curb frame and the member 38 there may be some form of an asphalt paper. This asphalt paper is not illustrated in FIG. 1.

After placement of the curb frame in the proper position about the skylight opening, then a series of the clips 40 are used for securing the curb frame in place. FIG. 1 illustrates one of these clips. FIG. 3 illustrates the clip in a perspective view and FIG. 2 illustrates what might be a typical placement of clips near to the mitered corner.

The flashing flange 50 is flexible and thus readily lifted upwardly, essentially pivoted at its end 58 so as to provide access to the base of the curb frame for insertion of the clips 40. The clips 40 as indicated previously are secured by means of a nail 44 or the like fastener. Thereafter, the flashing flange 50 is then moved downwardly to the position illustrated in FIG. 1 for covering the roof or other structure. Preferably, a plurality of these clips are used on each side of the skylight. The number of clips that are used are the function of the size of the skylight with the larger number of clips being used on larger skylights.

After the co-extruded flexible flashing flange has been placed in the manner illustrated in FIG. 1, then shingles 60 are placed thereover in the usual manner. In a preferred method of installation, the shingles 60 are disposed over the flange as illustrated. These shingles are arranged in the usual manner overlapping each other such as illustrated in copending application Ser. No. 453,339 filed Dec. 27, 1982. However, in accordance with the preferred procedure of installation, the shingles are not to be secured through the flashing flange 50. It is preferred not to pierce the flashing flange 50 with any nails. Instead, the nailing of each shingle occurs outside of the flashing flange. This minimizes any chance of water diversion through a hole created by a nail piercing the shingle and flashing flange.

With regard to FIG. 2, it is noted that the curb frame and the flashing flange are both joined at the miter 66. Because the curb frame and the flashing flange and glazing gasket are all formed integrally as a co-extrusion, these elements can also be cut at a bevel and remain at a co-extrusion. The individual parts once mitered are then heat welded to form a one-piece rectangular curb frame with an integral welded flashing skirt or flange about the entire curb perimeter as illustrated in the fragmentary view of FIG. 2.

Figure 4:
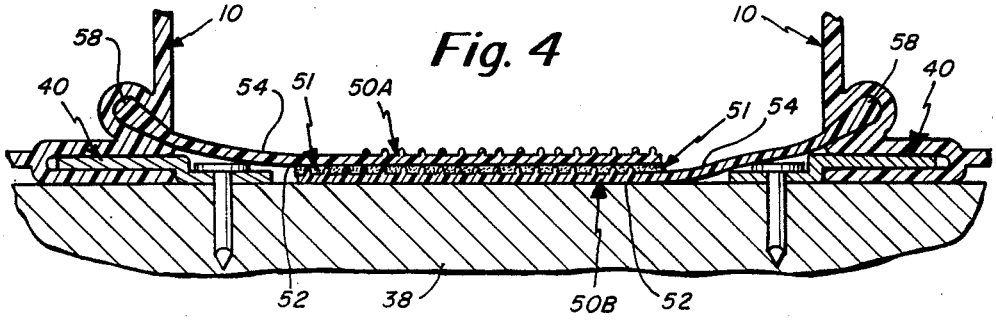
FIG. 4 is a fragmentary cross-sectional view illustrating the manner in which skylights can be arranged in adjacent position with the flashing flanges in an overlapping arrangement.

Reference is now made to the cross-sectional view of FIG. 4 which shows in a fragmentary view the joining essentially of adjacent skylights without requiring the use of any covering shingles. In this way, there can be an installation of a cluster of skylights without requiring complex custom units. This is carried out by simply trimming the flanges 50A and 50B in FIG. 4 if necessary. Trimming occurs depending upon the closeness with which the skylights are to be arranged. The glue is then applied at 51 between the overlapping portions of the flanges 50A and 50B. Once the flanges are glued, then there is formed an integral flexible flashing arrangement essentially providing a one-piece connection between skylights.

In connection with the method of installation of the present invention, it has been noted previously that shingles are provided over the flashing flange with instructions being provided not to pierce the flashing flange. In addition to that, it may also be preferred to provide a row of shingles under the flashing flange at the bottom of the skylight along with a row of shingles over the top of the flashing flange at the bottom of the skylight.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. In a skylight for covering an opening in a building having a rigid curb frame with means associated therewith for supporting a cover means, means for securing the curb frame to the building, and a flexible flashing flange extending from the base of the curb frame and disposed about the periphery of the curb frame, said flashing flange having a plurality of elongated spaced upstanding ribs that form flow diverters extending peripherally about the curb frame.

2. In a skylight as set forth in claim 1 wherein said flexible flashing flange is co-extruded with said curb frame with the flexible flashing flange being of a more flexible material in comparison with the rigid curb frame.

3. In a skylight as set forth in claim 1 wherein the co-extruded flexible flashing flange is wider than the curb frame.

4. In a skylight as set forth in claim 1 wherein said means for securing the curb frame to the building comprises clip means.

5. In a skylight as set forth in claim 1 including a second curb frame and associated flexible flashing flange in which said flashing flanges are adapted to overlap and be secured together.

6. In a skylight as set forth in claim 1 wherein the width of said flashing flange is on the order of 6 inches and the ribs are spaced on the order of $\frac{1}{8}$ inch apart.

7. In a skylight as set forth in claim 1 in combination with shingle means over the flashing flange, said shingle means adapted to be secured to the building but only outside of the flashing flange.

8. In a skylight as set forth in claim 1 further including a glazing gasket on the curb frame, wherein said glazing gasket and flexible flashing flange are both co-extruded with the rigid curb frame.

9. In a skylight as set forth in claim 4 wherein said curb frame has a base slot for receiving a portion of said clip means.

10. In a skylight as set forth in claim 9 wherein said clip means comprises one end that is adapted to be received by said slot and a second end that has a hole for receiving a nail or the like fastener.

11. In a skylight as set forth in claim 10 wherein one end of said flange is supported at said curb frame base but disposed over said curb frame base slot.

12. In a skylight for covering an opening in a building having a rigid curb frame with means associated therewith for supporting a cover means, in combination, a means for securing the curb frame to the building, a flexible flashing flange extending from the base of the curb frame and disposed about the periphery of the curb frame, said flashing flange having a plurality of elongated spaced upstanding ribs that form flow diverters extending peripherally about the curb frame, said flexible flashing flange being co-extruded with said curb frame with a flexible flashing flange being of a more flexible material in comparison with the rigid curb frame, said co-extruded flexible flashing flange being wider than the curb frame, said means for securing the curb frame to the building comprising clip means, said curb frame having a base slot for receiving a portion of said clip means, said clip means having one end that is adapted to be received by said slot and a second end that is a hole for receiving a nail or the like fastener, wherein one end of said flange is supported at said curb frame base but disposed over said curb frame base slot, the width of said flashing flange being on the order of 6" and the ribs being spaced on the order of $\frac{1}{8}$" apart, shingle means over the flashing flange, said shingle means adapted to be secured to the building, but only outside of the flashing flange, and a glazing gasket on the curb frame, wherein said glazing gasket and flexible flashing flange are both co-extruded with the rigid curb frame.

* * * * *